US008226494B2

(12) United States Patent
Miettinen et al.

(10) Patent No.: US 8,226,494 B2
(45) Date of Patent: Jul. 24, 2012

(54) GOLF DEVICE AND METHOD

(75) Inventors: Michael Miettinen, Tuusula (FI); Eljas Saastamoinen, Helsinki (FI); Jussi Rouhento, Helsinki (FI); Sami Ruotsalainen, Helsinki (FI)

(73) Assignee: Suunto Oy, Vantaa (FI)

( * ) Notice: Subject to any disclaimer, the term of this patent is extended or adjusted under 35 U.S.C. 154(b) by 37 days.

(21) Appl. No.: 11/176,359

(22) Filed: Jul. 8, 2005

(65) Prior Publication Data

US 2007/0010341 A1 Jan. 11, 2007

(51) Int. Cl.
*A63F 9/24* (2006.01)
*A63F 13/00* (2006.01)

(52) U.S. Cl. ..... 473/213; 473/212; 473/221; 473/222

(58) Field of Classification Search ..... 473/131, 473/151–152, 156, 192, 198, 199, 219–223, 473/212, 213; 434/252
See application file for complete search history.

(56) References Cited

U.S. PATENT DOCUMENTS

| | | | | | |
|---|---|---|---|---|---|
| 3,717,857 | A | * | 2/1973 | Evans | 340/870.13 |
| 3,945,606 | A | * | 3/1976 | McDonald | 251/326 |
| 3,945,646 | A | * | 3/1976 | Hammond | 473/223 |
| 4,126,314 | A | * | 11/1978 | Martin | 273/245 |
| 4,699,379 | A | * | 10/1987 | Chateau et al. | 473/59 |
| 4,821,218 | A | | 4/1989 | Potsch et al. | |
| 4,991,850 | A | | 2/1991 | Wilhlem | |
| 5,154,427 | A | * | 10/1992 | Harlan et al. | 473/218 |
| 5,233,544 | A | | 8/1993 | Kobayashi | |
| 5,349,853 | A | * | 9/1994 | Oehler | 73/167 |
| 5,375,610 | A | | 12/1994 | LaCourse et al. | |
| 5,607,361 | A | * | 3/1997 | Mastandrea et al. | 473/207 |
| 5,688,183 | A | * | 11/1997 | Sabatino et al. | 473/212 |
| 5,694,340 | A | | 12/1997 | Kim | |
| 5,792,000 | A | * | 8/1998 | Weber et al. | 473/223 |
| 5,871,406 | A | * | 2/1999 | Worrell | 473/221 |
| 5,907,819 | A | * | 5/1999 | Johnson | 702/152 |
| 6,014,887 | A | * | 1/2000 | Naruo et al. | 73/12.04 |
| 6,032,530 | A | | 3/2000 | Hock | |

(Continued)

FOREIGN PATENT DOCUMENTS

JP 05-023409 2/1993

(Continued)

OTHER PUBLICATIONS

"Standard Normal Scores / Z Scores / Z values", sourced from http://www.stats.uwo.ca/ugstudies/FallWinter99/hs201nov10.htm, published Nov. 10, 1999.*

*Primary Examiner* — Steven J Hylinski
(74) *Attorney, Agent, or Firm* — Birch, Stewart, Kolasch & Birch, LLP

(57) ABSTRACT

The invention relates to a portable device and a method for monitoring the performance a sportsman performing a plurality of motor acts, such as golf swings. The device comprises at least one sensor providing an output signal, the sensor being responsive to body movements of the sportsman. A signal processing unit is used for extracting data on the course of each of the plurality of motor acts from the sensor output signal, and a computing unit is used for determining, based on the data on the course of the plurality of motor acts, at least one characteristic number describing the repeatability of the motor act. By the means of the invention, the handicap number of the golfer can be predicted with good accuracy by monitoring several his or her subsequent swings.

15 Claims, 3 Drawing Sheets

U.S. PATENT DOCUMENTS

| | | | | |
|---|---|---|---|---|
| 6,073,086 | A | 6/2000 | Marinelli | |
| 6,227,984 | B1 * | 5/2001 | Blankenship | 473/221 |
| 6,261,102 | B1 * | 7/2001 | Dugan et al. | 434/252 |
| 6,441,745 | B1 * | 8/2002 | Gates | 340/669 |
| 6,487,906 | B1 | 12/2002 | Hock | |
| 6,533,675 | B2 * | 3/2003 | Funk | 473/222 |
| 6,607,450 | B1 * | 8/2003 | Hackman | 473/223 |
| 6,648,769 | B2 | 11/2003 | Lee et al. | |
| 6,778,866 | B1 | 8/2004 | Bettwy | |
| 6,821,211 | B2 * | 11/2004 | Otten et al. | 473/219 |
| 6,856,934 | B2 * | 2/2005 | Vock et al. | 702/149 |
| 6,959,259 | B2 * | 10/2005 | Vock et al. | 702/142 |
| 6,991,552 | B2 * | 1/2006 | Burke | 473/213 |
| 7,022,026 | B2 * | 4/2006 | Blankenship | 473/221 |
| 7,033,281 | B2 * | 4/2006 | Carnahan et al. | 473/221 |
| 7,041,014 | B2 * | 5/2006 | Wright et al. | 473/409 |
| 7,101,287 | B1 * | 9/2006 | Wagner | 473/207 |
| 7,143,639 | B2 * | 12/2006 | Gobush | 73/65.03 |
| 7,166,035 | B2 * | 1/2007 | Voges et al. | 473/222 |
| 7,271,774 | B2 * | 9/2007 | Puuri | 343/718 |
| 7,489,241 | B2 * | 2/2009 | Miettinen et al. | 340/572.1 |
| 2002/0187846 | A1 * | 12/2002 | Funk | 473/219 |
| 2003/0054327 | A1 | 3/2003 | Evensen | |
| 2003/0073518 | A1 | 4/2003 | Marty et al. | |
| 2003/0109322 | A1 * | 6/2003 | Funk et al. | 473/222 |
| 2004/0122538 | A1 * | 6/2004 | Gowan | 700/92 |
| 2004/0172213 | A1 * | 9/2004 | Kainulainen | 702/141 |
| 2005/0215335 | A1 * | 9/2005 | Marquardt | 473/131 |
| 2005/0261073 | A1 * | 11/2005 | Farrington et al. | 473/221 |
| 2005/0282650 | A1 * | 12/2005 | Miettinen et al. | 473/221 |
| 2006/0199659 | A1 * | 9/2006 | Caldwell | 473/221 |
| 2007/0010341 | A1 * | 1/2007 | Miettinen et al. | 473/131 |
| 2007/0091004 | A1 * | 4/2007 | Puuri | 343/718 |

FOREIGN PATENT DOCUMENTS

| | | |
|---|---|---|
| WO | WO-02/35184 | 5/2002 |
| WO | WO-2005/094949 | 10/2005 |

* cited by examiner

GOLF DEVICE AND METHOD

BACKGROUND OF THE INVENTION

1. Field of the Invention

The invention relates to golfing. In particular, the invention relates to a device for analyzing and developing skills of a player. The invention also concerns a method for analyzing the performance of the player during training or playing.

2. Description of Related Art

Golf is based on one's ability to predict the trajectory of a ball in response to a certain combination of swing and club. Swings of golfers are traditionally analyzed either by naked eye during the hit or by recording the swings using video equipment and analyzing them afterwards. In both cases, for a proper analysis of the pros and cons of the swing, a professional golf trainer is usually needed. Naked-eye and video-based evaluation of swings suits well for discerning major faults in, for example, the stance and alignment of the golfer and the movement of the body of the golfer during the swing. The results of such evaluation are also highly subjective and reflect the view of the person watching the swing, typically a golf trainer. For a golf trainee, it may be frustrating if several professional have different, probably opposing, views of the pros and cons of his or her shots. What is difficult to exactly evaluate by visual observation of the golfer, is the temporal progression of the swing and especially the similarity of two or more swings. In addition, hiring of a personal trainer having a suitable video equipment is very expensive, and the video equipment is difficult to carry.

U.S. Pat. No. 6,648,769 discloses a swing analyzing system comprising an instrumented golf club including a plurality of sensors, an internal power supply, an angular rate sensor and an internal ring buffer memory for capturing data relating to a golf swing. The swings are analyzed one-by-one for assisting a golfer's swing, or for designing an appropriate golf club for a specific type of golfer.

U.S. Pat. No. 6,073,086 discloses a device for measuring the speed of swing of a movable object, such as a baseball bat or golf club. Part of the device is embedded, secured, or attached to the projectile or movable object of interest, and consists of an acceleration sensor, threshold circuit, and a radio transmitter.

In U.S. Pat. No. 5,688,183 a velocity monitoring system for golf clubs is described. The monitor is preferably detachably securable to the golfer's hands or a golf glove. An inferential determination of club head velocity may be made by using an accelerometer disposed in the monitor.

U.S. Pat. No. 5,233,544 describes a swing analyzing device comprising swing practice equipment such as a golf club having acceleration sensors attached all over the club for analyzing the movements of the club with good precision during a swing.

U.S. Pat. No. 4,991,850 discloses a golf swing evaluation system including a golf club containing a sensor and an associated display for indicating the force and location of the impact of the club head against a golf ball.

The prior art devices make mostly use of acceleration sensors disposed in the golf club. However, such solutions usually change the properties of the club, whereby the measurement results may be unreliable. Moreover, in the above-mentioned devices, the analysis is based on monitoring swings one-by-one. They are well suited for practicing or improving technicalities of the swing. In monitoring the swing as a whole, or increasing or analyzing the attained muscle memory needed in golf, the present solutions are more unfavorable. Golf swing is a pendulum motion, not just hitting a ball with a club. A good swing is a combination of many factors, such as a right stance of the player, good balance throughout the swing, correct spatial course of the club and feasible temporal development of the swing. In order to reduce the number of shots required, the swing of the golfer has to be very constant and regular. If one or some of the preceding factors, for example, are irregular, the whole swing, and ultimately the flight path of the ball becomes unpredictable.

There are no known devices or methods which can be used for automatically and objectively analyzing the swing of a golfer in order to assist the golfer to improve his or her skills as a golf player.

SUMMARY OF THE INVENTION

It is an aim of the invention to achieve a novel device for helping sportsmen improve their skills by providing information on the repeatability of a motor act, especially a two-phase act such as a golf swing, that is frequently needed in the sport they go in for.

In particular, it is an aim of the invention to achieve a novel device and method for helping a golfer improve his or her skills by providing information on the repeatability of the swing of the golfer.

It is also an aim of the invention to achieve a novel method for determining the repeatability of a swing of a golfer using data collected during various swings.

It is a further aim of the invention to achieve a device that assists a golfer to focus his or her training on a specific part of the swing.

It is also an aim of the invention to provide a device and method, which can be used for obtaining objective information on the courses of swings.

The device according to the invention comprises means for collecting data on courses of repeatedly performed motor acts in response to body movements of the sportsman. In addition, the device comprises means for calculating at least one characteristic number based on the data collected during the motor acts. The means for collecting data comprise at least one sensor capable of delivering information (output signal) on the body movements of the sportsman during the motor acts and a signal processing unit for refining the information delivered by the sensor. The characteristic number represents, for example, repeatability of the different parts of the swing of the sportsman, i.e., how similar the various repetitions of the motor act are to each other in terms of the parameters measured.

The method according to the invention comprises monitoring the performance of a sportsman by collecting data on the course of a plurality of motor acts performed by the sportsman. Body movements of the sportsman are is sensed by an applicable sensor. The information provided by the sensor is then refined and used for calculating at least one characteristic number representing the repeatability of the motor act.

The motor act can be, for example, a swing performed by a golfer.

The data extracted from the sensor output signal can, for example, be used to describe one, some or all of the following swing properties: the tempo of the swing, the rhythm of the swing, the duration of the backswing and the velocity of the blade of the club during downswing. In this context, the tempo of the swing stands for the total duration of the swing, i.e., the time period from the beginning of the backswing to the completion of the swing. By the rhythm of the swing is meant the temporal proportions of the back- and downswing of the whole swing. The duration of the backswing is the time period from the beginning of the swing to the turning of the swing in the upper position of the club. In estimating the velocity of the club blade during downswing, pre-stored data on the length of the club can be used. When calculating the characteristic number(s), the mean values and standard deviations, for example, of the parameters measured can be used.

After several swings, the characteristic number(s) can be calculated from the measured parameters of each of the swings. Typically this step comprises calculating the coefficients of variation, and/or other applicable statistical quantities, of the swing properties for obtaining an objective criteria on the variability of the properties, and thus the repeatability of the swing parts the parameters represent. The step can also comprise calculating a weighed sum of some or all of the coefficients of variation for obtaining a characteristic number, which represents the overall repeatability of the swing in terms of several properties at once. In this document, this kind of weighed-sum characteristic number is also called a swing index number (SIN).

Considerable advantages are achieved by the present invention. A basic challenge in many sports, especially golfing, is that the temporal and spatial course of swing varies a lot from hit to hit. This causes the accuracy of the hits to decrease. In other words, the accuracy of the hits is highly dependent on the reproducibility of the swings. We have found that a reliable analysis of swings can be carried out automatically by a suitable electronic device, which can be mounted on the body or club of the sportsman. The variability of the swings can be detected by measuring certain parameters during the swings. The parameters can be used for pointing out the potential weaknesses and faults of a golfer by calculating various characteristic numbers, which represent different sectors of the swing or the swing as a whole.

In particular, we have found that determination of the key points of time of a plurality of swings is a good tool for identifying the weaknesses of the swing. This is because for example an unbalanced stance or irregular movement of the body of the golfer reflects in temporal variations. We have found also, that at least one acceleration sensor can be used for detecting the necessary key points reliably in order to make further analysis of the swing.

Advancing golfers change their way of swinging, the grip on the club or the set of clubs every now and then. These changes often involve also some changes in the temporal course of the swing. By using the device according to an embodiment of the present invention, golfers can track these temporal changes to see which parts of the swing are getting better (more constant) and which parts should still be improved. For example, the tempo of the swing can be well maintained constant in a new swing the golfer has practiced, but the duration of the backswing can deviate more than in his old swing.

The device according to an embodiment of the invention can be manufactured light, for example, to be carried on a wrist of the player. The player may start and stop monitoring of his or her swings whenever he or she wants. The device can be used during training, for example, on a driving of chipping range, but also during playing, for example, to monitor the similarity of several drives on teeing grounds.

The determined characteristic numbers of the swing of a player have been found to correlate well with the handicap (hcp) of the player. However, the index number describes the swing of the player more exactly, because the hcp is calculated by the overall performance of a player, including also the "swingless" areas of the game, such as mental and environment-dependent aspects of the game and putting. Hence, the characteristic number, especially the swing index number, determined by means of the invention, is a reliable measure of the hitting skills of a golfer.

According to one embodiment, the device informs the player which sector or sectors of the swing should be improved in order to make the swing more repeatable. This can happen by, after a predetermined number of swings, displaying several characteristic numbers representing different properties of the swing, to the user. This enables the player to concentrate his training on the weakest sector of the swing in order to enhance his or her skills towards more accurate shots. Alternatively or additionally, a swing index number representing the reproducibility of the swing as a whole can be displayed. In addition to displaying the results, there may be implemented also some advanced features in the device. The device can, for example, detect that the duration of the backswing fluctuates unacceptably much with respect to the fluctuations in the duration of the downswing and advice the player to concentrate on clean backswings in further training, or vice versa.

As is appreciated by a person skilled in the art, the device and method disclosed in this document can be used also for evaluating the shots and serves in other sports, such as tennis and baseball. In particular, the present solutions can be utilized in all kinds of sports making use of clubs, bats, sticks, racquets or mallets. In addition, the principles of the invention are applicable, for example, in ball games that require good body coordination and reproducibility of certain moves, such as basketball and boxing. For example in basketball, the reproducibility of free throws can be analyzed, and in boxing, the characteristics of the stretches and hooks can be analyzed.

In this description, golf terms such as backswing and downswing are used for describing the phases of the movement (motor act) in question of the sportsman. A person skilled in the art easily finds equivalent phases in many other sports. For example, when serves and hits of tennis are concerned, the backswing and downswing are easily distinguishable. In basketball, the equivalent phases are the small backpull of the player with a ball in his hands in front of his face and the stretching of hands when launching the ball towards the basket. As is the case in golf, also in basketball, the success of the throw is dependent on the ability of producing an exactly identical series of motion.

In many cases, the term "backswing" can thus be replaced with one of the terms "first phase of motor act", "preparatory step of effort" or "the step of collecting potential for a forthcoming effort". Respectively, the term "downswing" can usually be replaced with a term "second phase of motor act", "step of effort" or "the step of releasing the collected potential for performing an effort".

As is evident from the preceding disclosure and the description and claims hereafter, the term "swing" is used both in the meaning of a single swing and in a broader meaning describing the general hitting performance of a golfer (as in "repeatability of swing").

The term "course of swing/club" is used for describing the temporal course of the swing/club, including all time-related measurable quantities, such as acceleration, velocity and the spatial information on the device, on the golfer, or on the club in time. By the term "repeatability" or "reproducibility", we mean the similarity of at least two swings as regards to the courses of the swings.

Next, the invention will be examined more closely with the aid of a detailed description and with reference to the attached drawings.

DETAILED DESCRIPTION OF THE INVENTION

Figure 1A:
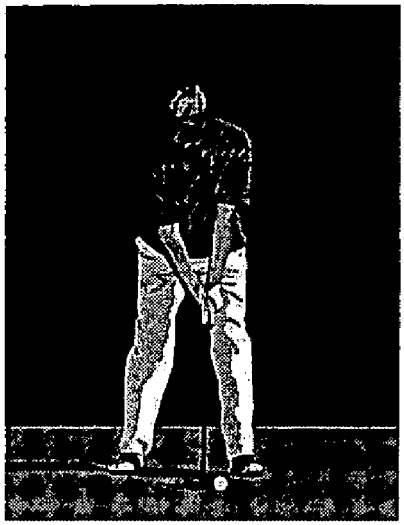
FIGS. 1*a* to 1*d* depict four different phases of golf swing as a series of images.
Figure 1B:
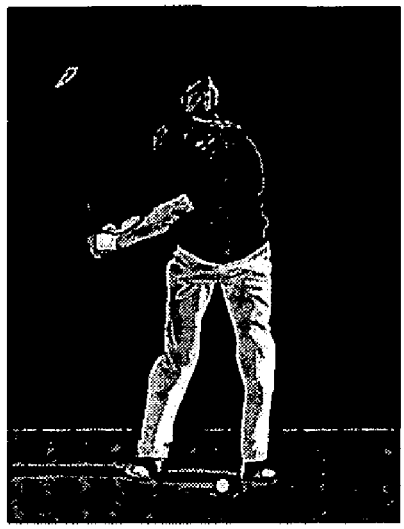
Figure 1C:
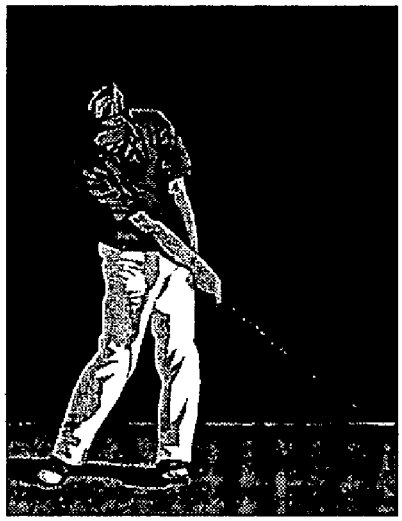
Figure 1D:
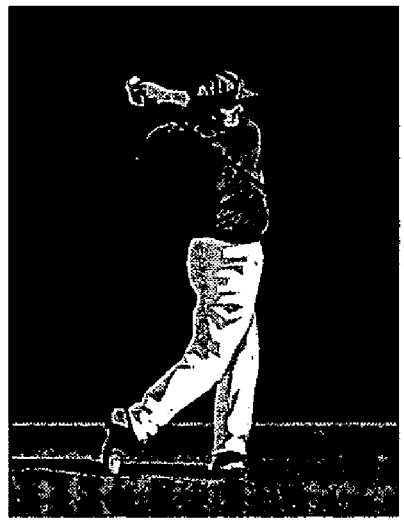

In determining the preferred properties of a swing (tempo, rhythm, duration of backswing, velocity of club blade), measuring of three different time points (also called "key points") is needed. Referring to FIGS. 1*a* to 1*d*, these time points comprise the time point when the hitter first moves the club from the starting position in order to perform the backswing (FIG. 1*a*), the time point when the hitter changes the direction of the swing when the club is in an upper position (FIG. 1*b*), and the time point when the swing is complete. This can mean either the time point when the club actually hits the ball (a little before the situation shown in FIG. 1*c*) or the time point when the downswing is fully finished off after the follow-through, once again in an upper position (FIG. 1*d*). In a preferred embodiment, the key points are determined using the data obtained from at least one acceleration sensor embedded in the device, preferably a 3D acceleration sensor or three different sensors arranged to provide information on the spatial movement of the sensors. In addition to the mentioned time points, also other parameters, such pure acceleration data or data derived from the accelerations in different phases of the swing, can be used.

Figure 2:
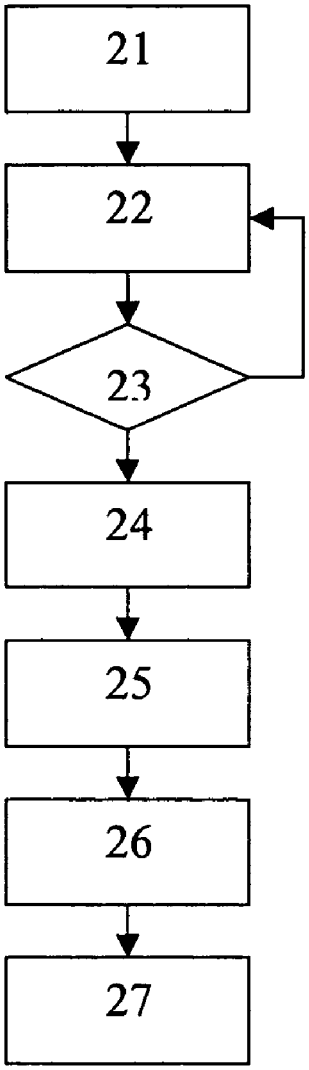
FIG. 2 shows a flow chart describing the progress of the method according to one embodiment.

In FIG. 2, the determination of characteristic numbers according to a preferred embodiment is illustrated by means of a flow chart. The chart and the following description on the progress of the monitoring program are only exemplary. It is appreciated by a person skilled in the art that the same or comparable results can be achieved by a number of different processes which do not deviate from the basic concept of the present invention.

The numerals in the FIG. 2 refer to following process steps:

21. Start the monitoring program

22. Detect the key points of a swing store predefined swing data

23. Check if a predetermined number of swings has been performed: No: go back to step 22, Yes: continue to step 24

24. Calculate coefficients of variation of predetermined properties of the swing

25. Calculate a weighed sum of the coefficients of variation calculated in step 14

26. Display results

27. End process

Starting of the monitoring program 21 is preferably done in response to user input. After starting, the device begins observing the movements of the player. In a preferred embodiment, the device includes a G-sensor or a set of G-sensors, which continuously provide data on the spatial movements of the device.

Swing detection in step 22 is preferably done using the acceleration data provided by the G-sensor(s). The device preferably detects and records the absolute or relative time points of the starting of the backswing ($t_{a,1}$), the reversal of the swing in the upper position of the club ($t_{a.2}$) and either the hitting of the ball or the ending of the follow-through after the downswing ($t_{a,3}$). In this document, these time points are denoted $t_{a,b}$, where a is the ordinal number of the swing and b is the ordinal number of the time point. The desired properties of the swing, for example, the tempo ($p_{a,1}$) and rhythm ($p_{a,2}$) of the swing, the duration of the backswing ($p_{a,3}$) and the velocity of the club head ($p_{a,4}$), can be calculated using the recorded time points in this step or in a later step (for example, step 24). In this document, the properties determined are denoted $p_{a,c}$, where a is the ordinal number of the swing and c is the ordinal number of the property. In this example, the number of properties (C) is 4, but it can also be more or less than that. The data can be temporarily stored in a built-in or portable memory of the device. Some embodiments concerning the practical implementation of the detection step are described more closely later in this document with reference to FIG. 4.

In step 23, the device decides, whether it has successfully detected and recorded a predefined number of swings (A) in order to calculate the characteristic number(s). The predefined number of swings is preferably 2-100, typically 5-20. The number may be given by the user or it may be preset into the memory of the device. In principle, the higher number of swings, the more statistically reliable the results are. In practice, however, the tiring and enervation of the player after a large number of similar shots may cause additional fluctuations to the measured swing parameters, whereupon the optimal number of swings can actually be quite low. It has been found, that by using the embodiments described in this document, even after a set of 10 swings, there is usually enough data to evaluate the hitting skills of a player with good accuracy.

In step 24, the mean values $\mu_c$, and standard deviations or are determined from the data set $p_{a,c}$. From the means and deviations, the coefficients of variation $CV_c$ of the selected swing properties are calculated to form characteristic numbers SC describing the reproducibility of the sub-parts c of the swing.

In an optional step 25, at least some of the quantities calculated in step 24 are weighed with weighing factors $w_c$ and summed to form a swing index number S. Thus, the swing index number S can be calculated as:

$$S = \sum_{c=1}^{C} w_c S_c. \tag{1}$$

The weighing factors $w_c$ can be chosen to take into account the importance of each of the sub-parts c in formation a successful swing. The weighing factors can also be chosen such that S represents the estimated hcp of the player. It is also possible to use a special weighing function(s) $f_c(S_c)$ and/or $f(S)$ in order to obtain results better corresponding to the real hcp of the player.

In step 26, the results of the monitoring program are displayed to the user on the display of the device. The display can comprise an LCD or TTT unit, for example. The characteristic number(s), i.e., the coefficients of variation $CV_c$ and/or the swing index number S can be displayed as pure numbers, for example, in percentages, and/or in a refined form, for example, graphically. In a further embodiment, the swing index number S in given hcp-units. Thus, the results can be displayed in the following way, for example:

Tempo: 5.5%
Rhythm: 19.4%
Length: 5.4%
Speed: 4.4%
SIN: 8.3% (hcp 23.6)

Figure 3:
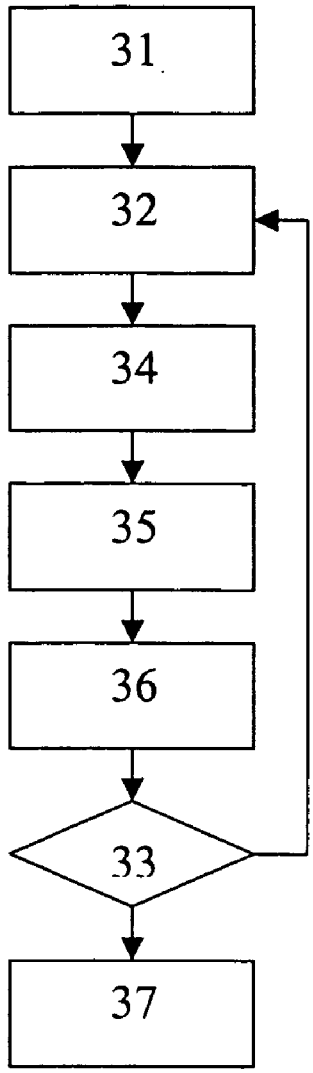
FIG. 3 shows an alternative flow chart describing the progress of the method according to another embodiment.

In FIG. 3 an alternative flow of the process is shown. In this version, the calculation is performed similarly to the calculation described above, but the results are shown to the user after every swing (except the first one). The reference numeral 31 corresponds to the numeral 21 in FIG. 2 etc.

Because coefficients of variation are calculated using statistical deviations, they are comparable despite the number of swings performed or the club used. The same applies to swing index numbers calculated from the coefficients.

In a further embodiment the user is also provided with absolute values of the properties determined. For example, the absolute the velocity of the club blade can be an interesting quantity when practicing long drives. Information can be provided on each swing individually or averaged over several swings.

Figure 4:
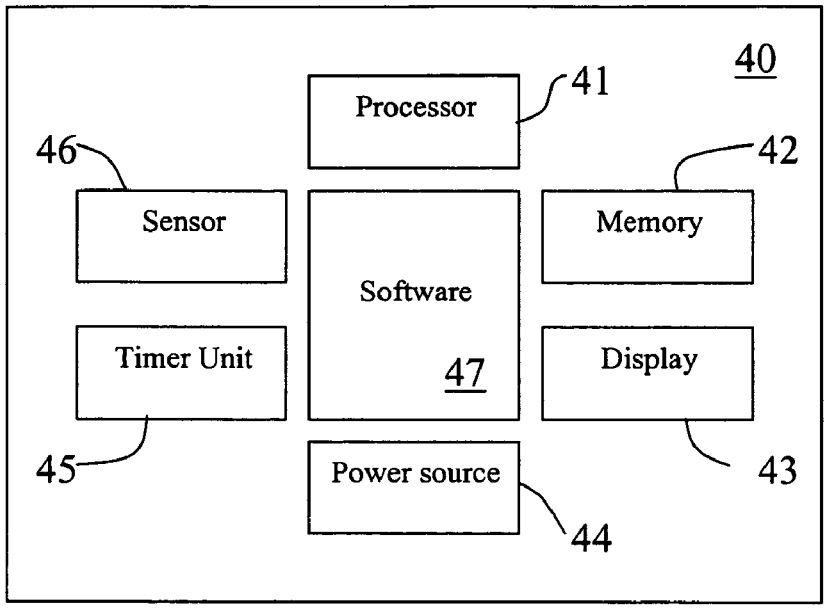
FIG. 4 shows a schematic view of the components of the device according to a preferred embodiment.

Referring to FIG. 4, the device 40 preferably comprises a power source 44, a timer unit 45, a sensor 46, a microprocessor 41, a memory unit 42 and a display unit 43. The devices is preferably driven by software 47 and also operated through a software-based user interface. Further, there may be means for transferring data to other devices, such as computers, by wire or wireless communication. In addition, the device can comprise other features commonly seen in wristop computers, such as climate sensors, a compass, an altitude meter or a GPS-locator. These features may also be utilized to provide additional useful information that can be used in advanced analysis of the skills of a golfer, for example, the variability of the swing in relation to prevailing weather conditions, or his moves on a golf course.

The sensor 46 comprises preferably an acceleration sensor (also "G-sensor") or a plurality of acceleration sensors, which provide electrical signal proportional to the acceleration of the device. Such sensors can be manufactured as separate microchips, as a part of another component, or embedded in the wiring board or casing of the device. The G-sensor used can be responsive to acceleration in all spatial directions (i.e. a 3D G-sensor) or there can be arranged several (typically three) sensors sensitive to different, for example, orthogonal directions of movement. Different types of G-sensors that can be used are, for example, those based on capacitive coupling and piezoelectric effect.

The sensor or sensors 46 can me arranged to provide a plurality of signals for each direction separately (vector acceleration) or a total acceleration signal (scalar sum). In order to provide accurate information on the movements of the club, the sensor is preferably mounted on an essentially fixed location with respect to at least one part of the club. In a preferred embodiment, the sensor is an integral part of the main device, for example, a wrist watch or wristop computer, whereby the sensors follow the motion of the club precisely enough to provide sufficient data on the swing. However, we do not exclude such embodiments, which utilize at least one external sensor installed, for example, on the blade of the club and communicating with the main device by wire or wirelessly.

In addition to or instead of a G-sensor, a sensor or a set of sensors of some other type can be used. For example, position, velocity, alignment or proximity sensors can be used to provide additional data for determining, or information that is sufficient for determining, the key points of the swing. This may, however, require positioning some sensor elements separately from the main device, for example, on hitting ground, ball or a body of the golfer.

The detection of the key points of the swing is performed using the output signal(s) of the sensor(s) 46. The signals can be in analogue or digital form. The detection process can also be implemented by analogue or digital means. If digital signal processing is utilized, analogue signals can be A/D-converted by suitable electronics before further analysis. The microprocessor 41 of the device is preferably used for digital signal processing. The acceleration data can also be calibrated, filtered and/or scaled before further analysis. If several sensors or sensor channels are used, arithmetic or algebraic operations can be carried out for forming derived data, such as sum signals or vector projections, e.g. for finding radial and tangential components, of acceleration data.

The detection can made in real time as the swing proceeds, in delayed real time, or after the swing has ended by analyzing stored signal data. In a preferred embodiment, the detection is carried out such, that when a key point of a swing is detected, its point of time is "stamped". That is, the point of time is stored in the memory of the device as an absolute value or as a relative value with respect to some other time point. In a preferred embodiment, the detection is primarily based on monitoring the value, first derivative and statistical variation of the total acceleration. Also secondary characteristics, such as properties of different acceleration components can be monitored.

There may be implemented several instructions for carrying out the detection of the key points. Examples of such instructions are given in the following list:

- Start of the swing: total acceleration is fairly constant (usually near the value 1 G, in most cases 0.5-1.5 G (G=gravity unit ≈9.81 $m/s^2$)).
- Start of the swing: the standard deviation of the acceleration data is low.
- Start of the swing: right before starting of the swing, total acceleration is essentially zero (the club is held motionless near the ball, probably resting on the hitting ground, as the player concentrates).
- Turning of the swing: radial acceleration begins to change after a period of constant acceleration.
- Turning of the swing: the direction (sign) of tangential acceleration changes.
- End of the swing: the total acceleration changes strongly during a short period of time (the club hits the ball and the linear momentum of the club decreases due to the impulse).

The above-listed instructions (and other such instructions) can be logically combined for enhancing the detection. For example, the start of the swing has been detected with good probability if two or three of the first listed requirements are met. On the other hand, the ending of the swing can only have happened if the swing has started and turned. By means of the detection process disclosed above, it is possible to implement a swing monitoring program that does not need any input from the user during the monitoring session. However, there can be also implemented interactive monitoring programs or semi-interactive monitoring programs. In an exemplary semi-interactive program the device informs the golfer by a sound signal when it is ready for a new swing after it has detected that the player is in starting stance (i.e., when the device has been essentially motionless for a while).

The swing detection system can also utilize higher level artificial intelligence, such as fuzzy logic or learning systems, which adapt to a certain style of swinging and thus provide more reliable results. Detection can also be implemented by storing swing data temporarily and comparing the data with a pre-recorded reference swing acceleration profile or profiles in order to find similarities between them and to detect the key points that way.

In one embodiment, the signal given by the sensor can also be stored for further analysis by the device or by external data processing means, such as a computer. By this embodiment, the swings of the golfer can be analyzed thoroughly and/or developing of the swing of a golfer can be monitored in the long run in detail.

A timer unit 45 is used for obtaining correct time stamps for the key points of a swing. A timer unit can comprise a timer used commonly for performing typical timing functions of wrist watches, for example.

The memory unit 42 may be comprised of built-in memory, portable memory, or both. The microprocessor 41 can be programmed to handle the signal processing needed in determining the key points of the swing and the calculations needed in determining the characteristic numbers. Alternatively, all or some of the processing and calculations can be performed using specialized electronic components, such as microchips. The raw of refined (extracted) data on the individual swings can also be transferred to separate data processing means, such as a computer, for calculation of the characteristic number(s).

In a preferred embodiment, all the steps needed for determining and reporting the characteristic number(s) are carried out in a single device. The device can be manufactured light and implemented as a wrist watch or wristop computer.

EXAMPLE 1

A test set of 10 wings of 12 different golfers was performed in order to illustrate the capabilities of the present device and method. Two swing properties were chosen to be monitored, namely the duration of the backswing (property 1) and the duration of the downswing (property 2). Table 1 shows the mean values (μ) and standard deviations (σ) of the results. Also the handicaps of the golfers are shown.

TABLE 1

Hcp's and mean values and standard deviations of two swing parameters of 12 testees performing 10 swings.

| Test Person | $\mu_1$ | $\sigma_1$ | $\mu_2$ | $\sigma_2$ | Hcp |
|---|---|---|---|---|---|
| 1 | 0.5860 | 0.041150 | 0.2200 | 0.009428 | 12.0 |
| 2 | 0.7200 | 0.023094 | 0.2900 | 0.010541 | 10.0 |
| 3 | 0.7340 | 0.016465 | 0.2500 | 0.010541 | 10.0 |
| 4 | 1.1360 | 0.020656 | 0.3420 | 0.014757 | 3.0 |
| 5 | 0.6920 | 0.013984 | 0.2760 | 0.008433 | 26.0 |
| 6 | 0.9740 | 0.037771 | 0.3620 | 0.006325 | 21.0 |
| 7 | 0.9230 | 0.029367 | 0.3017 | 0.005376 | 0.0 |
| 8 | 0.6004 | 0.017500 | 0.2472 | 0.017041 | 1.3 |
| 9 | 1.0668 | 0.070290 | 0.3445 | 0.014378 | 26.0 |
| 10 | 0.7504 | 0.066890 | 0.2472 | 0.017041 | 13.0 |
| 11 | 0.8445 | 0.021083 | 0.3835 | 0.017393 | 26.0 |
| 12 | 1.6221 | 0.115028 | 0.3934 | 0.013914 | 10.0 |

A classification matrix based on the data on Table 1 is shown in Table 2. A classification function was used to classify the test persons into two groups based on their swing index numbers calculated from $\sigma_1$ and $\sigma_2$. The groups consisted of those having a hcp between 0 and 10 and of those having a hcp more than 10. The results show, that only one test person was classified into a wrong group with the classification function used. Thus, the proportion of correct observations in this case is about 92%, the error rate being about 8%.

TABLE 2

Swing index and hcp classification matrix.

| | $0 \leqq$ hcp $\leqq 10$ (classified) | hcp > 10 (classified) |
|---|---|---|
| $0 \leqq$ hcp $\leqq 10$ (real) | 5 | 1 |
| hcp > 10 (real) | 0 | 6 |

The experimental results disclosed is this example illustrate the potential of the invention. It should be noticed that despite the low number of swings, namely 10, and only two parameters of interest used in the experiment, the derived swing index values correlate well with the hcp values of the players.

EXAMPLE 2

Figure 5:
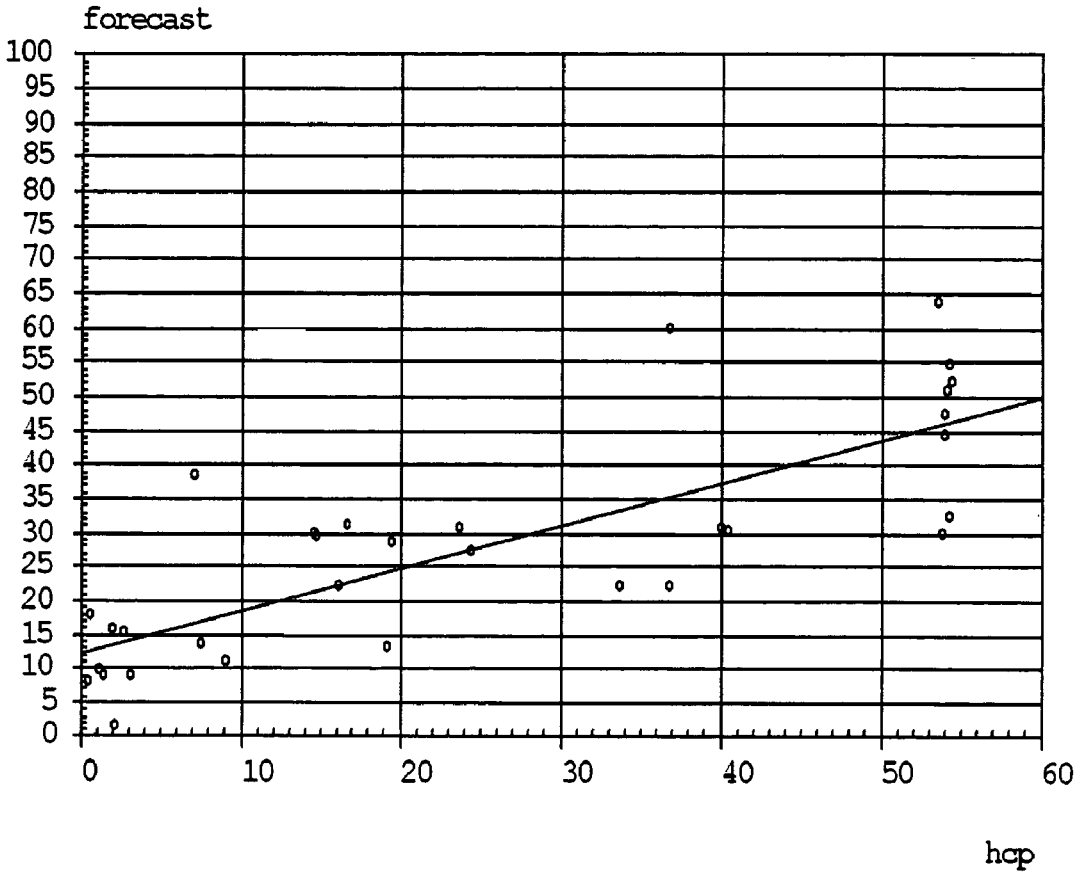
FIG. 5 shows a graph of predicted handicap values with relation to actual handicap values of 32 players.

FIG. 5 shows a graph of predicted handicap values with relation to official handicap values of 32 players. The official hcp is shown on the horizontal axis and the hcp-scaled swing index number obtained from a device (forecast) is shown on the vertical axis. Each of the players were asked to perform six as similar swings as possible. The swing index number was obtained with a wristop device using the principles described in this document.

The average predicted hcp of the players was 28 (st. dev. 20), the average actual hcp being 25 (st. dev. 16). The correlation factor between the predicted and actual hcp values was 0. 8. The correlation can be considered really high, taking into account that the number of repetition was only six.

The invention claimed is:

1. A wristop computing device for measuring the movement of a user's wrist while performing a series of swings of an object comprising:

a housing attachable to a users wrist and measuring the bodily movement of the wrist within different defined areas of temporal space, the housing containing at least:

a timing device, at least one sensor which is responsive to movement and arranged to generate a sensor output signal, a signal processing unit arranged to extract data on the course of each of the swings from the sensor output signal, said data including key time points of the swings, a computing unit arranged to calculate at least one statistical value representative of the user's repeatability of the series of swings using said extracted data from the signal processing unit; and a forecasted handicap for the user, which is directly comparable to the user's actual handicap;

wherein the forecasted handicap is based in part on the at least one statistical value; and a display unit arranged to display at least one of the statistical value and forecasted handicap calculated by the computing unit.

2. A device according to claim 1, wherein the at least one sensor comprises an acceleration sensor.

3. A device according to claim 1, wherein the signal processing unit is adapted to extract data on two-phase motor acts comprising a first phase of the motor act and a second phase of the motor act, such as a golf swing, from the sensor output signal.

4. A device according to claim 3, wherein the signal processing unit is adapted to detect the time points of starting of the motor act, the intervening of the first and second phases of the motor act and ending of the motor act.

5. A device according to claim 1, which comprises a microprocessor programmed to perform at least some of the functions of the signal processing unit and the computing unit.

6. A device according to claim 1, wherein the at least one statistical value characterizes the overall repeatability of the series of swings, and is selected from the group of: tempo of the series of swings, rhythm of the series of swings, duration of the first phase of the series of swings, velocity of the series of swings.

7. A device according to claim 1, which further comprises a memory unit for temporarily storing at least part of the data on the course each of the plurality of swings, at least one key button for receiving user input, and a display.

8. A device according to claim 1, which is adapted to perform an automatic multiple monitoring program of the plurality of swings in response to user input and reporting the at least one characteristic number to the user.

9. A method of forecasting a golfer's actual golf handicap by:

(a) attaching a wristop computing device to a golfer's wrist and measuring the bodily movement of the golfer's wrist within different defined areas of temporal space, the wristop computing device comprising a timing device, at least one sensor which is responsive to movement and arranged to generate a sensor output signal, a signal processing unit, a computing unit and a display unit;

(b) extracting data on the course of a series of swings of the golfer in the signal processing unit of the wristop computing device from the sensor output signal of the at least one sensor, the extracted data including key time points of the swings;

(c) computing at least one statistical value representative of the golfer's repeatability of the series of swings in the computing unit of the wristop computing device using the extracted data from the signal processing unit;

(d) computing a forecasted golf handicap of the golfer, which can be compared to the golfer's actual golf handicap, in the computing unit based in part on the at least one statistical value; and displaying the forecasted golf handicap of the golfer on the display unit of the wristop computing device.

10. A method according to claim 9, wherein at least one acceleration sensor is said sensor.

11. A method according to claim 9, wherein a single microprocessor is utilized for performing the steps of extracting and computing.

12. A method according to claim 9, wherein the step of extracting data is adapted to enable extracting data on two-phase motor acts comprising a first phase of the motor act and a second phase of the motor act, such as said series of swings of said golfer, from the sensor output signal.

13. A method according to claim 12, wherein the step of extracting comprises detecting the time points of starting of the motor act, the intervening of the first and second phases of the motor act and ending of the motor act.

14. A method according to claim 9, wherein the at least one characteristic number characterizes the overall repeatability of the motor act, and is selected from the group of: tempo of the motor act, rhythm of the motor act, duration of the first phase of the motor act, velocity of the motor act.

15. A method according to claim 9, which further comprises displaying the at least one characteristic number to the golfer.

* * * * *